US006683407B2

(12) United States Patent
Lisitsyn et al.

(10) Patent No.: US 6,683,407 B2
(45) Date of Patent: Jan. 27, 2004

(54) LONG LIFE FLUORESCENT LAMP

(75) Inventors: Igor Lisitsyn, Beachwood, OH (US); Gerald E. Sasser, III, Lyndhurst, OH (US); Thomas F. Soules, Richmond Heights, OH (US); William Edwin Jackson, Solon, OH (US)

(73) Assignee: General Electric Company, Schenectady, NY (US)

( * ) Notice: Subject to any disclaimer, the term of this patent is extended or adjusted under 35 U.S.C. 154(b) by 194 days.

(21) Appl. No.: 09/897,856

(22) Filed: Jul. 2, 2001

(65) Prior Publication Data

US 2003/0015956 A1 Jan. 23, 2003

(51) Int. Cl.[7] ..... H01J 1/62
(52) U.S. Cl. ..... 313/489
(58) Field of Search ..... 313/485, 486, 313/487, 489, 639, 636, 637

(56) References Cited

U.S. PATENT DOCUMENTS

| | | | | |
|---|---|---|---|---|
| 3,780,329 A | | 12/1973 | Otsuka et al. | |
| 3,780,330 A | | 12/1973 | Otsuka et al. | |
| 4,583,026 A | | 4/1986 | Kajiwara et al. | |
| 4,717,607 A | * | 1/1988 | Pfizenmaier et al. | 428/34.6 |
| 4,935,664 A | * | 6/1990 | Whitney et al. | 313/493 |
| 5,008,789 A | | 4/1991 | Arai et al. | |
| 5,051,653 A | | 9/1991 | DeBoer et al. | |
| 5,523,655 A | * | 6/1996 | Jennato et al. | 315/246 |
| 5,602,444 A | | 2/1997 | Jansma | |
| 5,754,002 A | * | 5/1998 | Haitko et al. | 313/565 |
| 5,777,434 A | * | 7/1998 | Dietrich et al. | 313/565 |
| 5,838,100 A | | 11/1998 | Jansma | |

OTHER PUBLICATIONS

European patent application No. 84108487.4, Filed Jul. 18, 1984 (Publication No. 0 131 965 A2, Publication Date Jan. 23, 1985).

* cited by examiner

*Primary Examiner*—Sandra O'Shea
*Assistant Examiner*—Sumati Krishnan
(74) *Attorney, Agent, or Firm*—Pearne & Gordon LLP

(57) ABSTRACT

A long life mercury vapor discharge lamp is provided. The lamp has a ultraviolet-reflective barrier layer, a rare earth triphosphor layer coated on the barrier layer, and a fill gas of mercury vapor and argon. Most preferably, the barrier layer has a coating weight about 2.6, mg/cm$^2$, the phosphor layer has a coating weight of about comprising a light-transmissive glass envelope having an inner surface, means for providing a discharge, an ultraviolet reflecting barrier layer comprising alumina particles coated adjacent said inner surface of said glass envelope, a phosphor layer coated adjacent said barrier layer, and a discharge-sustaining fill gas of mercury vapor and argon sealed inside said envelope, said fill gas having a pressure of 2.9–5 torr at 25° C., said phosphor layer having a coating weight of 2–3.5 mg/cm2.

20 Claims, 1 Drawing Sheet

LONG LIFE FLUORESCENT LAMP

BACKGROUND OF THE INVENTION

1. Field of the Invention

The present invention relates generally to a fluorescent lamp, and more particularly to a long life fluorescent lamp adapted to function with high frequency electronic ballasts already present in the marketplace.

2. Description of Related Art

T8 fluorescent lamps have become quite popular in North American markets, and have largely supplanted the previous generation T12 fluorescent lamps due to their inherent higher efficiency. A typical North American 4-foot T8 fluorescent lamp using the known three component rare earth phosphor blends operates on a high frequency electronic ballast and has a life of about 20,000 hours.

It is desirable to increase the life of T8 fluorescent lamps, preferably by at least 30% (i.e. to at least 26,000 hours). There currently exist no long-life lamps having a life of at least 26,000 hours. Furthermore, conventional and known methods for extending lamp life (i.e. use of heavier gases, such as krypton, in the fill gas; use of double cathodes; etc.) often reduce lumen output compared to standard lamps.

While longer lamp life translates into cost savings to the consumer, it is unlikely that consumers will be willing to sacrifice performance for service life. In addition to cost savings, longer life is also desirable to reduce the environmental impact associated with frequent disposal of mercury-containing burned-out fluorescent lamps.

Consequently, there is a need for a long life T8 fluorescent lamp having a life of at least 26,000 hours that produces similar light (lumen) output compared to standard T8 lamps. Preferably, such a long-life lamp functions with currently emplaced high-frequency electronic ballasts.

SUMMARY OF THE INVENTION

A long life mercury vapor discharge lamp is provided having a light-transmissive glass envelope that has an inner surface, means for providing a discharge, an ultraviolet reflecting barrier layer of alumina particles coated adjacent the inner surface of the glass envelope, a phosphor layer coated adjacent the barrier layer, and a discharge-sustaining fill gas of mercury vapor and argon sealed inside the envelope. The fill gas has a pressure of 2.9–5 torr at 25° C., and the phosphor layer has a coating weight of 2–3.5 mg/cm$^2$.

DETAILED DESCRIPTION OF THE PREFERRED EMBODIMENTS OF THE INVENTION

Figure 1:
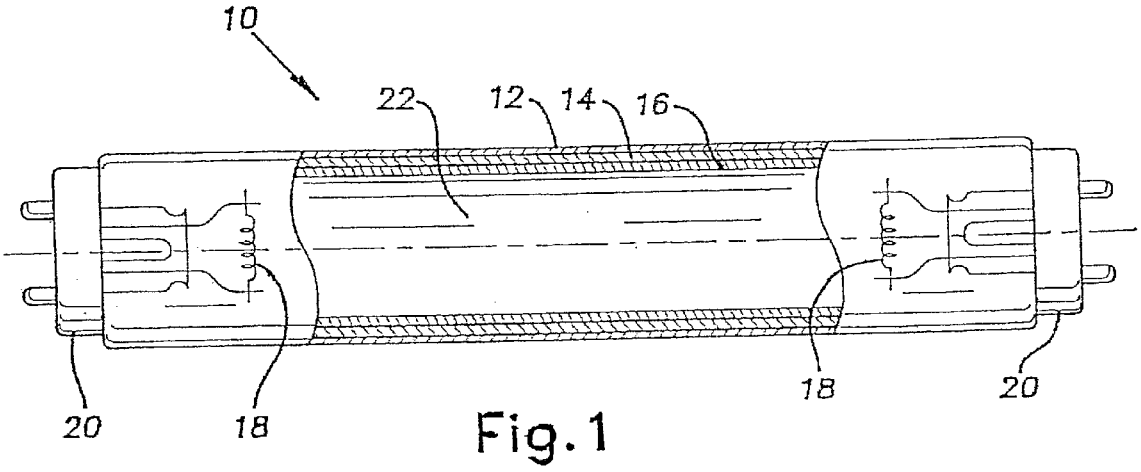
FIG. 1 shows a representative low pressure mercury vapor discharge lamp according to the present invention.

In the description that follows, when a preferred range, such as 5 to 25 (or 5–25), is given, this means preferably at least 5, and separately and independently, preferably not more than 25. As used herein, "electronic ballast" means a high frequency electronic ballast as known in the art, comprising a light weight solid state electronic circuit adapted to convert a line voltage AC input signal into a high frequency AC output signal in the range of 20–150, more preferably 20–100, more preferably 20–80, more preferably 20–50, more preferably 25–40, kHz, and having an output voltage in the range of 150–1000V. The electronic ballast preferably is an instant-start ballast and is adapted to operate a T8 fluorescent lamp as known in the art. Less preferably, the ballast can be a rapid-start ballast as known in the art.

Also as used herein, a "T8 fluorescent lamp" is a fluorescent lamp as commonly known in the art, preferably linear with a circular cross-section, preferably nominally 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet long, less preferably some other length. Alternatively, a T8 fluorescent lamp may be nonlinear, for example circular or otherwise curvilinear, in shape.

A "T12 fluorescent lamp" is a linear fluorescent lamp as commonly known in the art having a nominal outer diameter of 1.5 inches, being similar to a T8 lamp in other relevant respects.

As used herein and in the claims, wattages are as measured on the standard IES 60 Hz rapid start reference circuit known in the art.

FIG. 1 shows a low pressure mercury vapor discharge fluorescent lamp 10 according to the invention. The fluorescent lamp 10 has a light-transmissive glass tube or envelope 12 which has a circular cross-section. The glass envelope 12 preferably has an inner diameter of 2.37 cm, and a length of 118 cm, though the glass envelope may have a different inner diameter or length. An ultraviolet (UV) reflecting barrier layer 14 is coated adjacent, preferably in direct contact with, the inner surface of the glass envelope 12. Barrier layer 14 preferably comprises a mixture of alpha- and gamma-alumina particles, and has a coating weight of 0.1–3, preferably 0.5–0.7, mg/cm$^2$.

A phosphor layer 16 is coated adjacent the inner surface of the barrier layer 14, preferably on the inner surface of the barrier layer 14. Phosphor layer 16 is preferably a rare earth phosphor layer, such as a rare earth triphosphor layer known in the art. Less preferably, phosphor layer 16 can be a halophosphate phosphor layer as known in the art, which would produce lower lumens but still achieve longer life compared to a standard T8 lamp.

The lamp is hermetically sealed by bases 20 attached at both ends, and a pair of spaced electrode structures 18 (which are means for providing a discharge) are respectively mounted on the bases 20. A discharge-sustaining fill gas 22 of mercury and an inert gas is sealed inside the glass tube. The inert gas is preferably 100% substantially pure argon (i.e. the fill gas contains no krypton). The inert gas and a small quantity of mercury provide the low vapor pressure manner of operation.

The fill gas 22 preferably has a total pressure of 2.9–5, preferably 3–4.5, preferably 3–4.2, preferably 3.1–4, preferably 3.1–3.9, preferably 3.2–3.7, preferably 3.5, torr at 25° C. The fill gas pressure in standard T8 fluorescent lamps is 2.5 torr at 25° C., and that of several existing long life T8 lamps, (e.g. F32T8/XL by General Electric, F32T8/TL by Philips, and FO32/XP by Osram), is about 2.8 torr at 25° C. Increasing the total fill gas pressure from about 2.5 to 2.8 torr in these existing lamps provides about a 20% increase in lamp life, though at the expense of light output (lamp lumens). Increased fill gas pressure (outside the range of about 1.5–2.5 torr) results in poor lamp performance, specifically reduced lumens and higher starting voltage. Such negative effects of higher fill gas pressures in fluorescent lamps are well known, and are discussed, for example, in J. F. Waymouth, Electric Discharge Lamps, MIT Press, Cambridge, 1971.

A long life fluorescent lamp according to the present invention produces similar lumens compared to standard T8 lamps despite increasing the amount of argon in the fill gas, and thereby the fill gas pressure. Long life (at least 26,000 hours) and lumen output retention are achieved via the novel combination of elevated argon pressure as discussed above, the combination of increased phosphor coating weight using a triphosphor blended layer and a UV reflective coating layer as discussed below.

The phosphor layer 16 preferably comprises a mixture of red, green and blue emitting rare earth phosphors, preferably a triphosphor mixture. The red emitting phosphor is preferably yttrium oxide activated with europium ($Eu^{3+}$), commonly abbreviated YEO.

The green emitting phosphor is preferably lanthanum phosphate activated with cerium ($Ce^{3+}$) and terbium ($Tb^{3+}$), commonly abbreviated LAP. Less preferably the green emitting phosphor can be cerium, magnesium aluminate activated with terbium ($Tb^{3+}$), commonly abbreviated CAT, less preferably gadolinium, magnesium pentaborate activated with cerium ($Ce^{3+}$) and terbium ($Tb^{3+}$), commonly abbreviated CBT, less preferably any other suitable green emitting phosphor as known in the art.

The blue emitting phosphor is preferably calcium, strontium, barium chloroapatite activated with europium ($Eu^{2+}$), less preferably barium, magnesium aluminate activated with europium ($Eu^{2+}$), less preferably any other suitable blue emitting phosphor known in the art.

The three triphosphor components are combined on a weight percent basis as known in the art to obtain preselected lamp colors. Typical lamp colors include those having correlated color temperatures (CCT) of nominally 3000K, 3500K, 4100K, 5000K, and 6500K, though the triphosphors can be beneficially combined in relative weight percent ratios to yield a lamp having other predetermined color temperatures. The color temperatures are preferably at least or not more than those set forth above, or preferably plus or minus 50K, 100K, 150K or 200K. The lamp colors preferably lie within two, three or four MPCD steps of the standard CIE colors corresponding to the above CCTs.

In a less preferred embodiment, rare earth phosphor blends comprising other numbers of rare earth phosphors, such as systems with 4 or 5 rare earth phosphors, may be used in the phosphor layer 16.

The general coating structure is disclosed in U.S. Pat. No. 5,602,444. As disclosed in the '444 patent, the UV-reflective barrier layer 14 comprises a blend of gamma- and alpha-alumina particles coated on the inner surface of the glass envelope 12, and a phosphor layer 16 coated on the inner surface of the barrier layer 14.

The phosphor layer 16 of the present invention is disposed on the inner surface of the UV-reflective barrier layer 14 and has a coating weight of preferably 2–3.5, more preferably 2.2–3.2, more preferably 2.4–3, more preferably 2.5–2.8, more preferably about 2.6, mg/cm$^2$. This represents a significant increase in coating weight over the prior art, e.g. U.S. Pat. Nos. 5,008,789, 5,051,653, and 5,602,444, where typical coating weights of approximately 1.2 and 1.7 mg/cm$^2$ have been employed, for example, in General Electric Company's well known STARCOAT™ SP and SPX type lamps respectively. Low coating weights traditionally have been desirable as a cost-saving measure because lamp cost is a strong function of coating weight. However, a long life T8 fluorescent lamp according to the present invention, though nominally more expensive, has about or at least a 30, preferably 35, preferably 40, preferably 45, preferably 50, preferably 55, percent longer life than standard T8 lamps, corresponding to a lamp life of about or at least 26,000, preferably 27,000, preferably 28,000, preferably 29,000, preferably 30,000, preferably 31,000, hours when used in conjunction with existing electronic ballasts. Increased phosphor coating weight, in conjunction with the alumina barrier layer 14 as described above, result in greater than 99% absorption of all the UV radiation generated by the discharge, and subsequent conversion into visible light. This results in about a 3% increase in efficiency over existing high performance General Electric SPX lamps which are generally known in the art. Hence, fluorescent lamps of the present invention consume less energy to produce the same lumens (i.e. at least 2800 lumens which is typical of a standard T8 lamp) due to improved lamp efficiency. A lamp having the novel combination of fill gas composition and elevated pressure, phosphor composition and elevated coating weight, and alumina barrier layer composition and coating weight, as described above, reduces power consumption and enhances lamp life without sacrificing lumen output.

The invention will be understood, and particular aspects of the invention further described, in conjunction with the following examples.

EXAMPLES

Example 1

A lamp according to the present invention was tested on a variety of instant-start electronic ballasts common in the marketplace via the ASV (Absolute Starting Voltage) lamp test method. The tested lamp had an argon pressure of 3.2–3.7 torr, a triphosphor coating weight of about 2.6 mg/cm$^2$, and an alumina barrier layer coating weight of 0.5–0.7 mg/cm$^2$. Surprisingly, it was found that the tested lamp exhibited good lamp starting on all high frequency electronic ballasts tested without the use of a starting aid, despite the elevated fill gas pressure above 2.5 torr. Consequently, a lamp according to the invention can be employed in conjunction with, and is adapted to be effectively electrically coupled to, electronic ballasts already present in the marketplace, meaning that consumers can immediately begin using the invented fluorescent lamps in existing fluorescent lighting fixtures.

Example 2

A long life 4-foot T8 lamp according to the present invention was tested on the standard IES 60 Hz reference circuit, and its performance compared with that of a standard 4-foot T8 lamps on the same circuit. The results are shown below in Table 1.

TABLE 1

| | | Comparison of performance between invented and standard T8 fluorescent lamps | | | | | | |
|---|---|---|---|---|---|---|---|---|
| Lamp | Color Temp. | Gas Composition | Gas Press. (Torr) | Coating Weight (mg/cm$^2$) | X | Y | Power Consumption (Watts) | 100-Hour Lumens |
| Standard T8 | 3500K | 100% Argon | 2.5 | 1.9 | 0.4129 ± .0005 | 0.3942 ± 0.0008 | 32.6 ± 0.2 | 2855 ± 11 |

TABLE 1-continued

| Lamp | Color Temp. | Gas Composition | Gas Press. (Torr) | Coating Weight (mg/cm$^2$) | X | Y | Power Consumption (Watts) | 100-Hour Lumens |
|---|---|---|---|---|---|---|---|---|
| | | Comparison of performance between invented and standard T8 fluorescent lamps | | | | | | |
| Invented T8 | 3500K | 100% Argon | 3.6 | 3.0 | 0.4130 ± 0.0005 | 0.3911 ± 0.0008 | 30.8 ± 0.2 | 2930 ± 17 |

As can be seen in table 1, the invented long life T8 lamp consumed about 5.5% less power and yielded about 2.6% increased lumen output at 100 hours compared to the standard T8 lamp. The standard T8 lamp yielded about 88 lumens/watt while the improved long life T8 lamp yielded 95 lumens/watt at 100 hours. Preferably, the invented lamp yields at least 88 lumens/watt to match the standard lamp performance, more preferably at least 95 lumens/watt.

Also as seen from table 1, the invented lamp experienced negligible discoloration. (X and Y in table 1 represent the red and green chromaticity coordinates respectively of the lamps, and both are virtually constant between the invented and standard lamps). Furthermore, an invented T8 lamp has nominally identical color rendering index (CRI) characteristics compared to equivalent standard T8 lamps. Hence, the invented lamps can be employed in virtually all lighting applications where current T8 lamps are used, their CRI characteristics being similarly tunable through proper selection of triphosphor weight percent ratios in the phosphor layer 16. A lamp of the present invention preferably has a CRI of at least 50, preferably at least 60, preferably at least 70, preferably at least 75, preferably at least 80.

A lamp employing the novel combination of features as disclosed herein (i.e. fill gas consisting essentially of mercury vapor and argon at elevated pressure, elevated phosphor coating weight, and an alpha- and gamma-alumina blended UV-reflective barrier layer) produces substantially the same or greater lumens, and has similarly tunable color rendering and color temperature characteristics, as a standard fluorescent lamp while having at least a 30% longer life. In addition, the above novel combination of features results in a lamp having equivalent or superior lumen maintenance compared to a standard T8 lamp. Lumen maintenance is calculated as the ratio of mean lumens (over the lamp's life) to 100-hour lumens. Despite long life, an invented lamp has a lumen maintenance ratio of at least 95% when used in conjunction with a rapid start ballast.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge fluorescent lamp comprising a light-transmissive glass envelope having an inner surface, means for providing a discharge, an ultraviolet reflecting barrier layer comprising alumina coated adjacent said inner surface of said glass envelope, a phosphor layer coated adjacent said barrier layer, and a discharge-sustaining fill gas sealed inside said envelope, said fill gas consisting essentially of mercury vapor and argon and having a pressure of at least 2.9 torr at 25° C. and not more than 5 torr at 25° C., said phosphor layer having a coating weight of at least 2 mg phosphor per cm$^2$ and not more than 3.5 mg phosphor per cm$^2$.

2. A lamp according to claim 1, said phosphor layer comprising a blended triphosphor system of red, green, and blue color emitting rare earth phosphors.

3. A lamp according to claim 1, said barrier layer comprising a mixture of alpha- and gamma-alumina particles, said barrier layer being in direct contact with said inner surface of said glass envelope.

4. A lamp according to claim 1, said barrier layer having a coating weight of 0.1–3 mg/cm$^2$.

5. A lamp according to claim 4, said fill gas having a pressure of 3.2–3.7 torr at 25° C. and said phosphor layer having a coating weight of 2.4–3 mg/cm$^2$.

6. A lamp according to claim 4 having a lumen maintenance ratio of at least 95%.

7. A lamp according to claim 1, said barrier layer having a coating weight of 0.5–0.7 mg/cm$^2$.

8. A lamp according to claim 1, said phosphor layer having a coating weight of 2.4–3 mg/cm$^2$.

9. A lamp according to claim 1, said fill gas having a pressure of 3–4.5 torr at 25° C.

10. A lamp according to claim 1 having a lumen efficiency of at least 88 lumens/watt.

11. A lamp according to claim 1 having a lamp life of at least 26,000 hours.

12. A lamp according to claim 1, wherein said lamp produces at least 2800 lumens at 100 hours.

13. A lamp according to claim 1, said lamp having a CRI of at least 75.

14. A lamp according to claim 1, wherein said lamp is a T8 fluorescent lamp.

15. A lamp according to claim 1, said phosphor layer being a halophosphate phosphor layer.

16. A mercury vapor discharge fluorescent lamp comprising a light-transmissive glass envelope having an inner surface, means for providing a discharge, an ultraviolet reflecting barrier layer comprising alumina coated adjacent said inner surface of said glass envelope, a phosphor layer coated adjacent said barrier layer, and a discharge-sustaining fill gas sealed inside said envelope, said fill gas consisting essentially of mercury vapor and argon and having a pressure of 3.2–3.7 torr at 25° C., said phosphor layer having a coating weight of about 2.6 mg/cm$^2$ and said barrier layer comprising a mixture of alpha- and gamma-alumina and having a coating weight of 0.5–0.7 mg/cm$^2$.

17. A lamp according to claim 16, said phosphor layer comprising a blended triphosphor system of red, green, and blue color emitting rare earth phosphors.

18. A lamp according to claim 16 having a lamp life of at least 26,000 hours and a lumen maintenance ratio of at least 95%.

19. A lamp according to claim 1, said lamp being a single-tube fluorescent lamp.

20. A lamp according to claim 1, wherein said lamp has a lamp life of at least 28,000 hours.

* * * * *